US006802079B2

(12) United States Patent
Bush

(10) Patent No.: US 6,802,079 B2
(45) Date of Patent: Oct. 12, 2004

(54) PROTECTIVE MOUTH SHIELD

(76) Inventor: David Bush, 264 Beatree La., Aston, PA (US) 19014

( * ) Notice: Subject to any disclaimer, the term of this patent is extended or adjusted under 35 U.S.C. 154(b) by 0 days.

(21) Appl. No.: 10/424,901

(22) Filed: Apr. 28, 2003

(65) Prior Publication Data

US 2004/0006804 A1 Jan. 15, 2004

Related U.S. Application Data

(63) Continuation of application No. 10/120,126, filed on Apr. 10, 2002, now Pat. No. 6,553,569.
(60) Provisional application No. 60/206,453, filed on May 22, 2000.

(51) Int. Cl.[7] ..... A41D 13/00
(52) U.S. Cl. ..... 2/9; 128/857
(58) Field of Search ..... 2/9, 174, 424, 2/427, 206, 425, 452; 128/857, 859, 848, 861, 206.12, 206.15, 206.17, 206.27, 206.21, 206.29, 207.11, 707.14; 602/17, 74

(56) References Cited

U.S. PATENT DOCUMENTS 1,216,679 A * 2/1917 Foster ..... 602/902
1,296,946 A * 3/1919 Galiardo ..... 128/204.11
5,335,371 A 8/1994 Spessard
5,717,993 A * 2/1998 Roberts ..... 2/9
5,911,308 A 6/1999 Chafitz et al.
6,148,820 A * 11/2000 Herrin ..... 128/857
6,553,569 B2 * 4/2003 Bush ..... 2/9

* cited by examiner

*Primary Examiner*—Tejash Patel
(74) *Attorney, Agent, or Firm*—Eugene E. Renz, Jr.

(57) ABSTRACT

A mouth protector assembly comprising a grid-like mouth protector, defined by a top bar contoured to engage the area above the upper lip and below the nose of a user, a series of spaced bars depending from the upper bar and a pad which underlies the chin of a user, a strap system for supporting the grid over the mouth including straps connected to the grid and encircling the head to support the grid over the mouth of the user.

6 Claims, 9 Drawing Sheets

PROTECTIVE MOUTH SHIELD

This is a continuation of Parent Application, Ser. No.: 10/120,126, entitled, PROTECTIVE MOUTH SHIELD filed Apr. 10, 2002, now U.S. Pat. No. 6,553,569.

This Continuation Application claims priority from Provisional Patent Application No.: 60/206,453, filed May 22, 2000.

FIELD OF THE INVENTION

The present invention represents a significant innovation in the area of sports safety, as relates to so-called "protective mouth shields".

BACKGROUND OF INVENTION

Presently, the use of mouth guards placed in the mouth, i.e., intra-oral mouth guards to protect against concussion is quite common in athletics. These mouth guards are typically made of a plastic or rubber material and are of general "U"-shape cross-section to fit over the teeth of the user.

While these guards certainly serve a useful function, they are not designed to shield the mount and teeth from impact, but rather are intended to prevent concussion. Within the universe of all athletes susceptible to injury to the teeth, a hazard exists, peculiar to the sub-group of athletes who wear braces. Impact injuries to the mouth of a brace wearer , which intra-oral mouth guards cannot prevent can range from internal lacerations of the cheeks, lips and gums, to painful trapping of the lips or cheek in the brace. Additionally, damage to the braces themselves, from impact with other players, balls, etc. commonly occur, necessitating costly repairs.

Currently, extra-oral protection for the teeth and mouth is limited to those sports in which the players are permitted to wear helmets, such as ice hockey and football. Wire mesh "face cages" in hockey and face masks in football require a helmet to which they are attached.

The present invention is unique in that it provides protection form injury to brace and no-brace wearing athletes in sports in which helmets are not used, either by custom, such as basketball, or by the inherent nature of the game such as soccer. In the case of soccer, use of the head to direct the ball is an integral part of the game, and helmets cannot be worn as to do so would significantly alter the character of the sport. As such, no means of extra-oral protection from potentially catastrophic injury to the teeth with the attendant pain and treatment costs, currently exists for the millions of soccer or basketball players.

The invention comprises a strap system, enabling independent wear, for supporting a grid-like plastic protector which overlies the mouth of the user and by protruding outward truly protects the teeth and mouth of the user, including those wearing braces. The invention prevents impact to the mouth. The unique character of the invention is it suitability for non-helmet sports. The strap system is designed to facilitate easy and quick positioning of the mouth protector in place and easy adjustment for comfort and stability.

The invention can of course be utilized in conjunction with an intra-oral mouth guard. If used alone, however, in addition to its superior ability to prevent injury to the teeth and mouth, the invention, unlike an intra-oral guard, does not impede verbal communication by the user, a significant consideration in team sports.

The efficacy of the invention is particularly acute in light of the tremendous expansion in recent years of organized sports programs, particularly soccer, among both genders. As part of that expansion, participation begins at earlier ages and children as young as four years of age, who now regularly engage in team sports. The invention is particularly-attractive to the parents of such young children.

BRIEF DESCRIPTION OF THE DRAWINGS

These and other objects of the present invention and the various features and details of the operation and construction thereof are hereinafter more fully set forth with reference to the accompanying drawings.

DETAILED DESCRIPTION OF THE PREFERRED EMBODIMENTS

Figure 1:
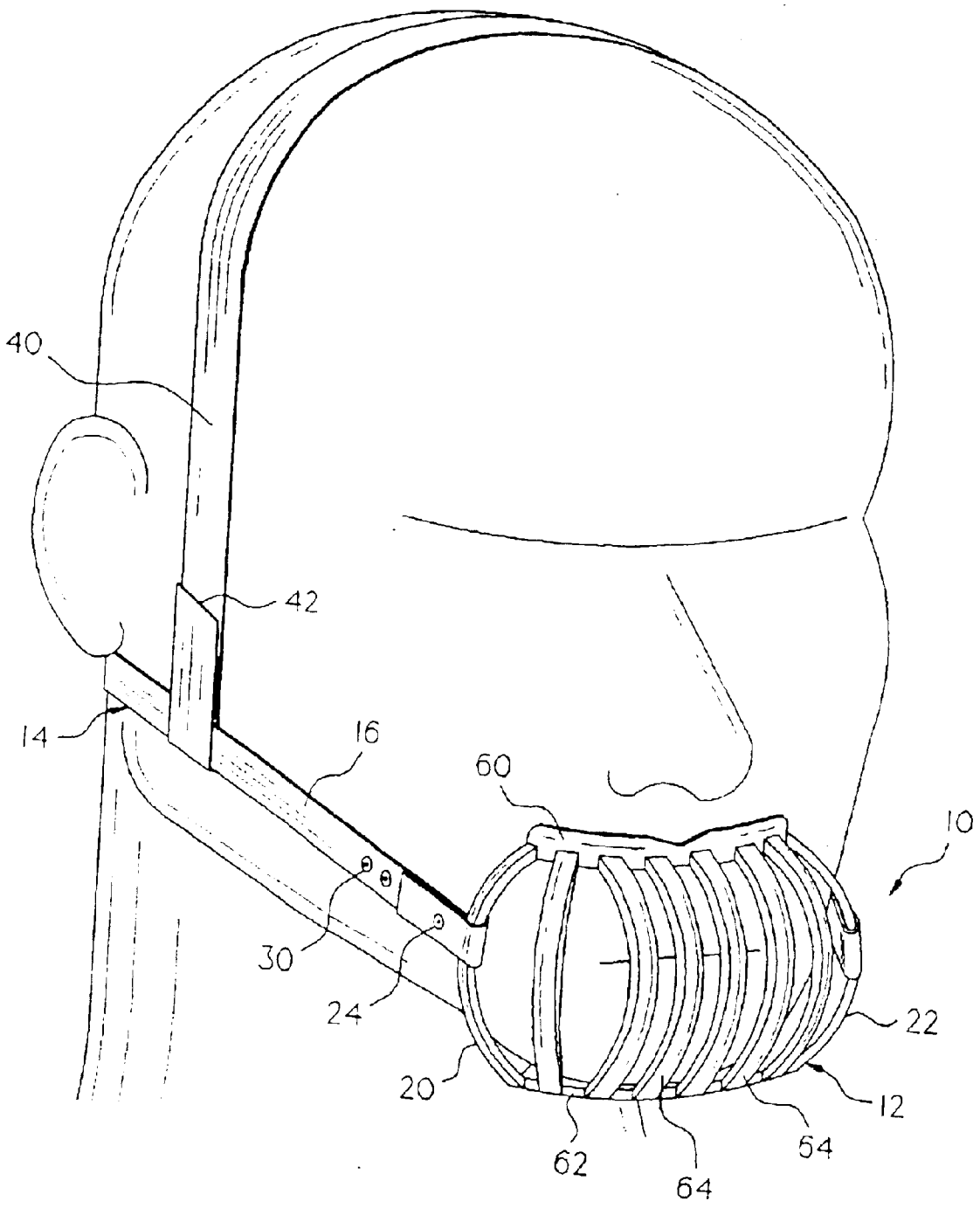
FIG. 1 is perspective view of my invention for protective mouth guard.
Figure 2:
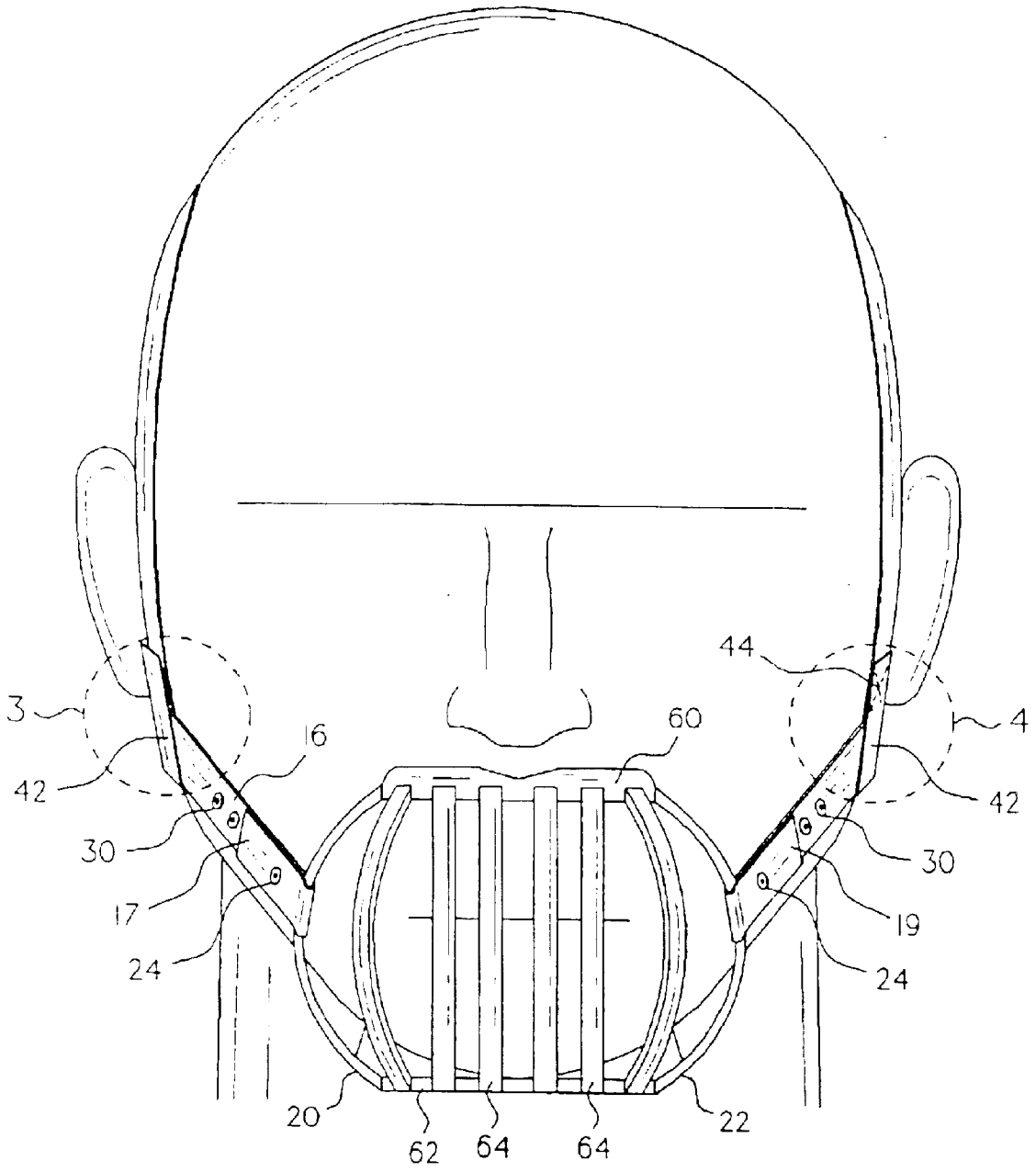
FIG. 2 is a front elevational view showing the mouth guard in place on the head of the user.
Figure 3:
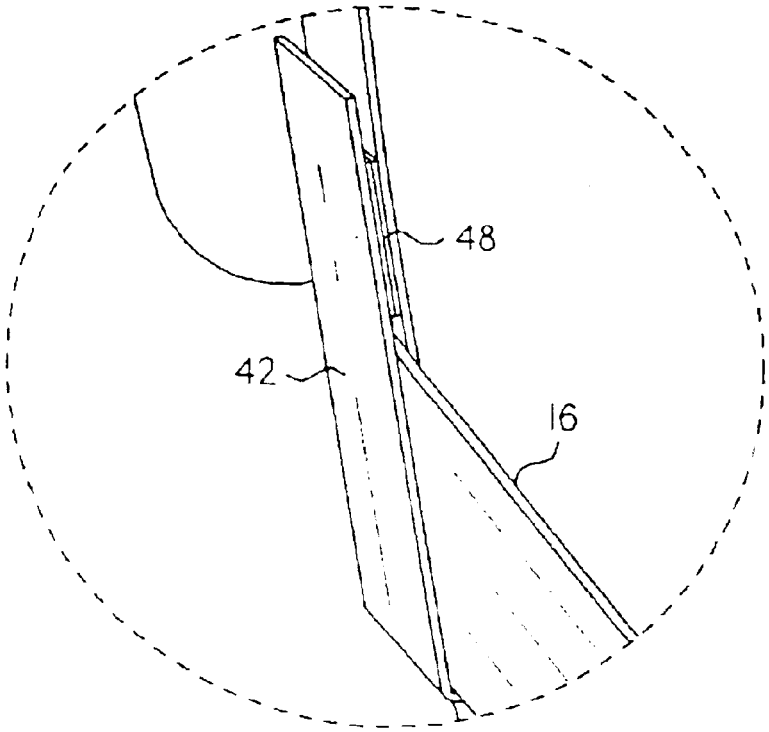
FIG. 3 is an enlarged fragmentary perspective view of the strap configuration at one side of the protective mouth guard cage, shown in broken lines in FIG. 2 and identified as numeral "3"
Figure 4:
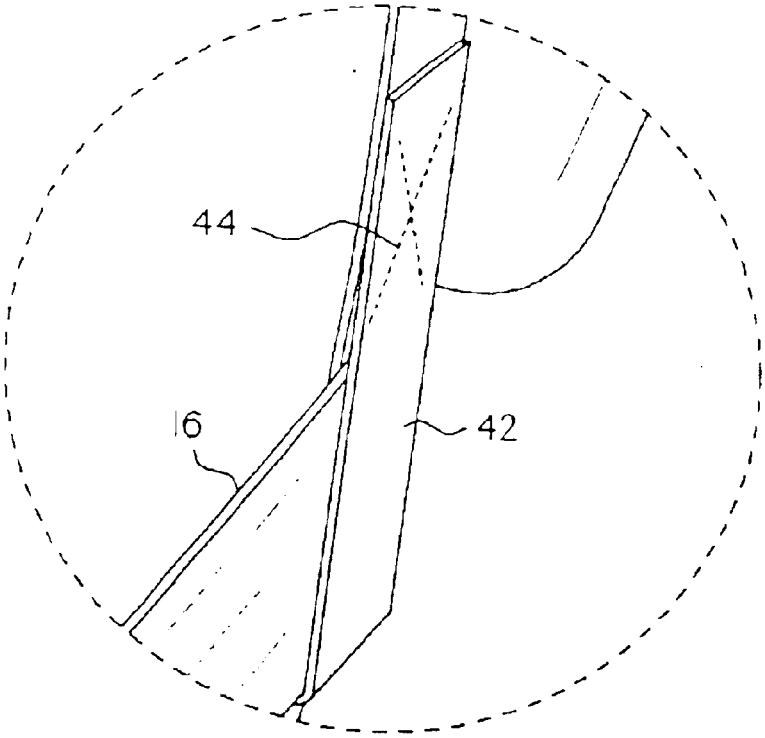
FIG. 4 is an enlarged perspective view showing the strap configuration at the opposite side.

Referring now to the drawings and particularly to FIGS. 1 and 2, thereof, there is shown a mouth protector assembly in place on the head of the user made in accordance with the present invention and generally designated by the numeral 10. The assembly comprises essentially a grid-like mouth protector 12 and a strap-like head support system designated by the numeral 14 for supporting the mouth protector 12 in place over the mouth of a user in the manner shown. The strap system 14 may be made of a suitable fabric having a degree of elasticity and comprises a first lower support strap 16 which as illustrated in FIGS. 1 and 2 is connected to the outer bars 20, 22 of the grid-like mouth guard 12 and encircles the neck of the user below the ear in the manner shown in the drawings. The terminal ends 17 and 19 of the strap 16 loop around the outer bars 20, 22 of the mouth guard and are secured by snap fasteners 24 or velcro. The snap fasteners 24 are of the conventional type having male and female elements 26 and 28, respectively. The strap has a series of spaced fastening elements 30 to allow for adjustment of the strap 16 and ensure a snug fit.

Figure 5:
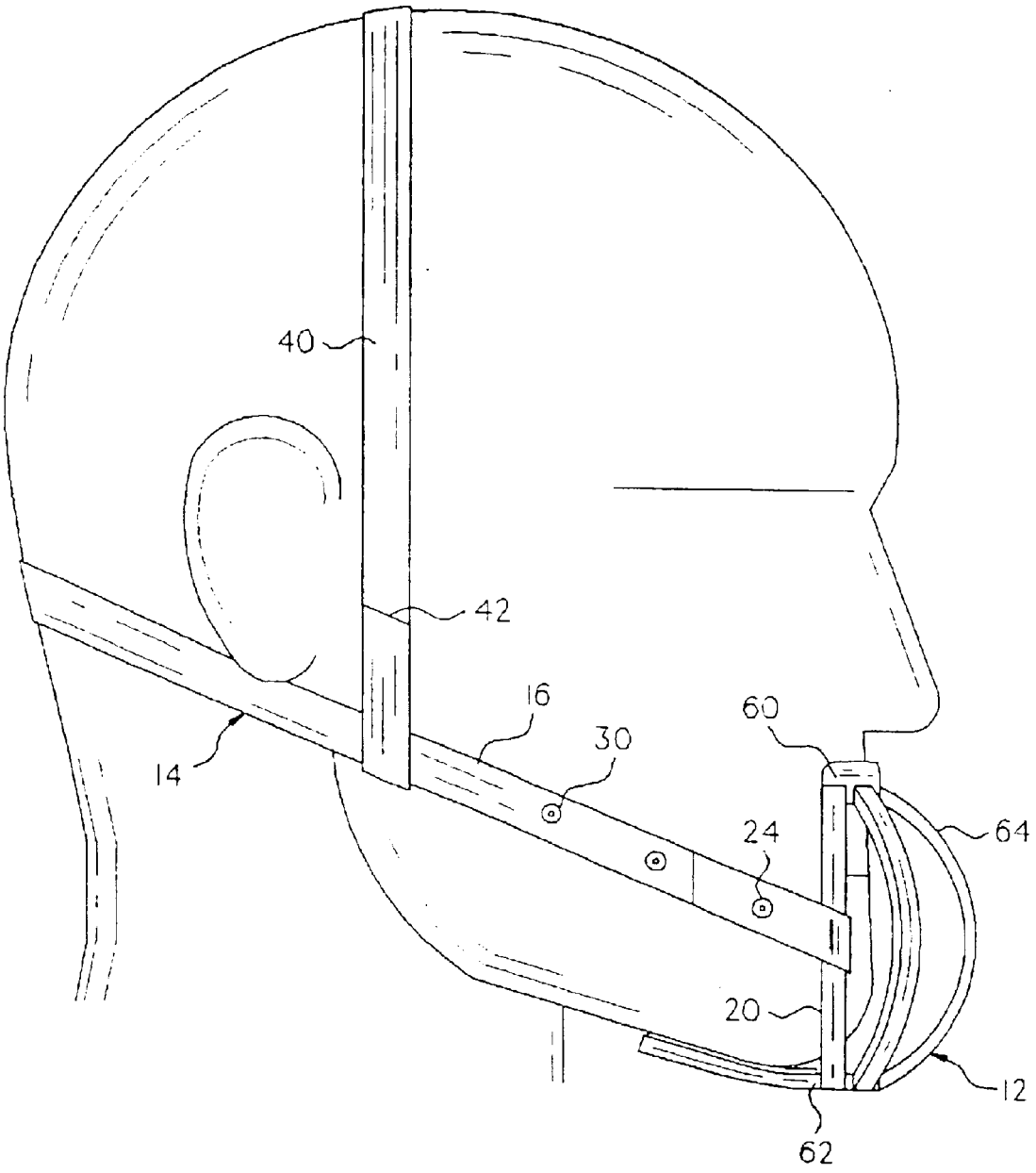
FIG. 5 is a side elevational view of the mouth guard protective assembly.
Figure 6:
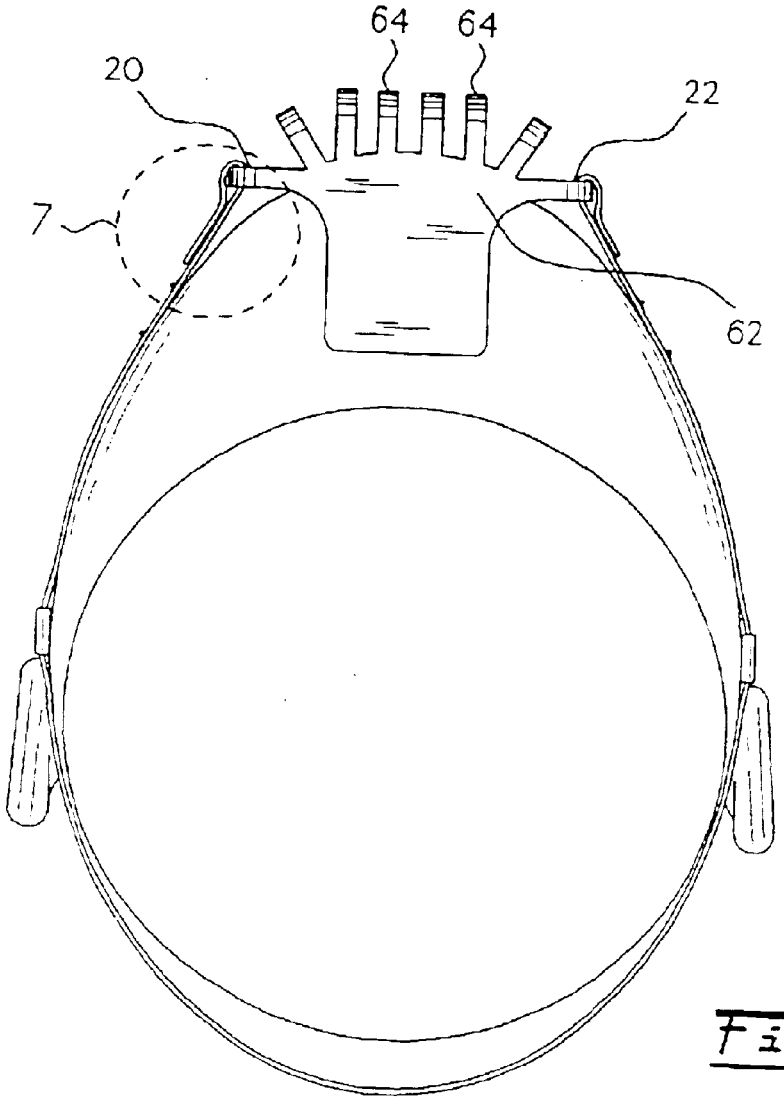
FIG. 6 is a bottom plan view of the present invention.
Figure 7:
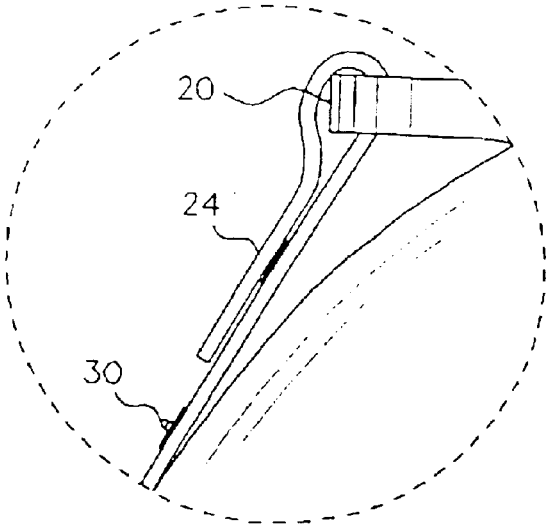
FIG. 7 an enlarged view showing the connection of the strap to the protector cage circled in broken lines in FIG. 6 and identified by the numeral "7"

The strap system 14 as illustrated also includes a so-called upper support strap 40 which in the present instance is looped over terminal ends as at 42 to connect it to the lower support strap 16 with a sliding fit. One of the end loops 42 is permanently secured by stitching or the like at 44 and the other end loop 42 is folded over on itself and detachably connected by Velcro® or the like as at 48. This arrangement permits sliding adjusting movement of the upper strap 40 to a comfortable position on the top of the head. The mouth protector element 12 comprises, as best shown in FIGS. 1 and 2, a generally rectangular frame comprising a top bar 60 which is contoured to press comfortably against the face of the user below the nose and above the lip in the manner shown in FIGS. 1 and 2 and a base pad 61 underlying the chin as shown in FIG. 5. There are a series of outwardly bowed ribs 64 spanning the upper bar 60 and front edge 62 of pad 61, including two outer ribs 20 and 22 to which the lower strap 16 is attached. This arrangement provides a comfortable and protective shield for the mouth and teeth of the user.

Figure 8:
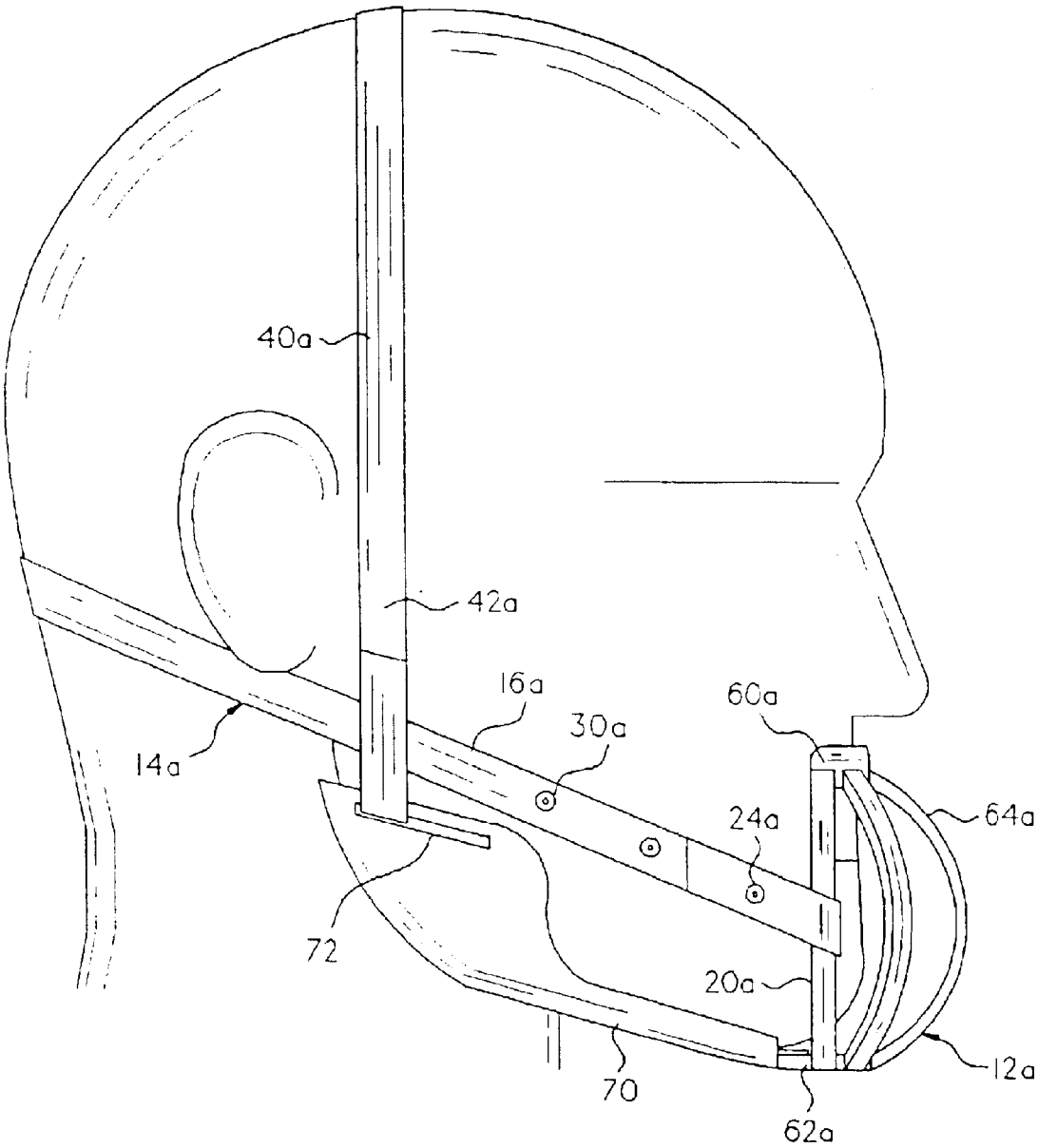
FIG. 8 is a side elevational view of a modified protector assembly in accordance with the present invention.

There is shown in FIG. 8 another embodiment of the mouth protector assembly in accordance with the present invention where some of the element or components of the assembly are the same as in the principal embodiment and are therefore assigned the same references numbers with subscript "a". Thus, the protector assembly includes a lower strap 16*a*, a grid-like mouth protector 12*a* for the mouth and teeth area of the user and a upper strap which spans the head of the user in the same manner as in the principal embodiment. However, in the present instance, the assembly includes a contoured lower jaw piece 70 made of a plastic material and the upper strap 40*a* is connected thereto in the manner shown by engaging through a slotted opening 72 in the jaw piece 70. The jaw piece 70 are formed integrally with the base pad 61.

Figure 9:
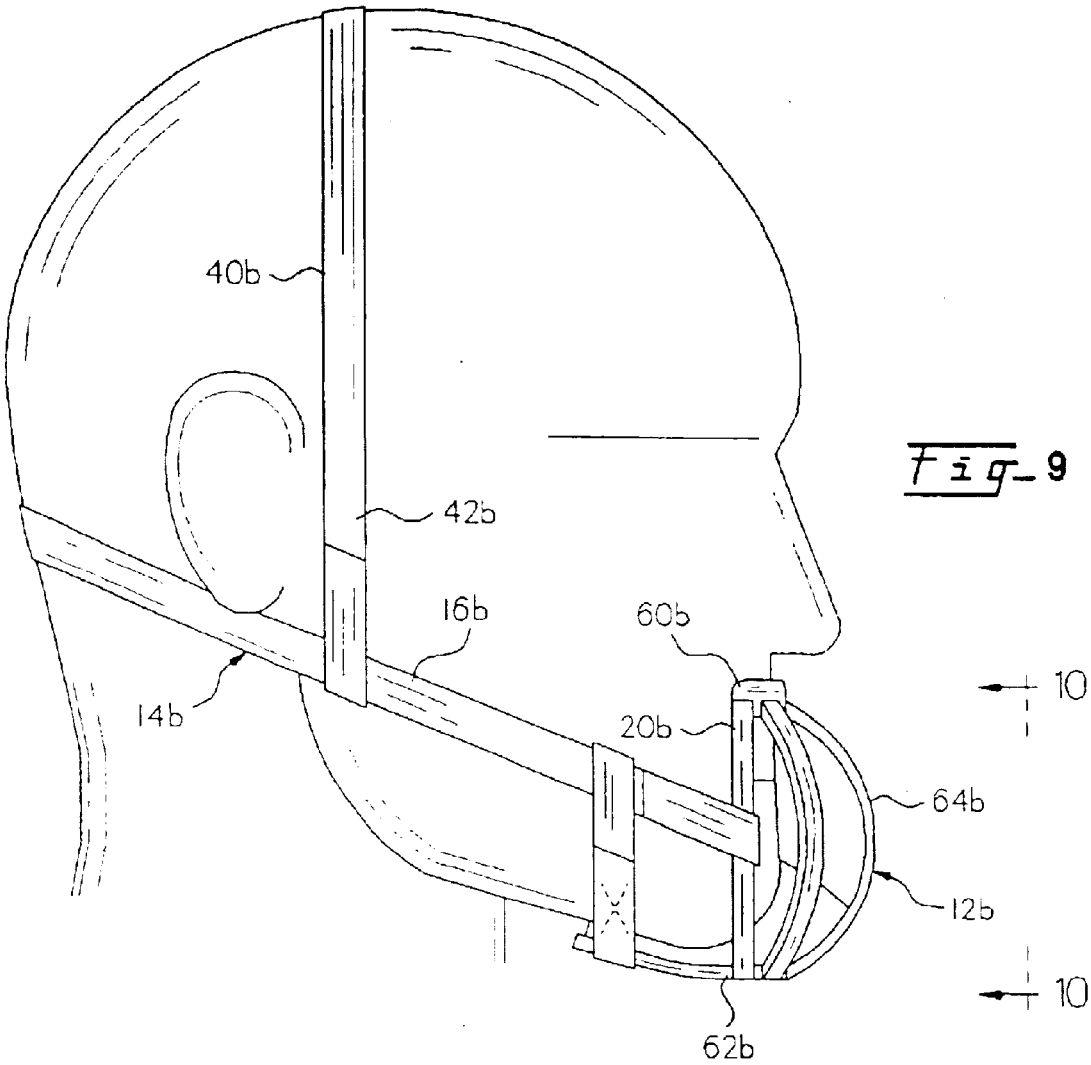
FIG. 9 is a side elevational view of another embodiment of a mouth guard assembly in accordance with the present invention.
Figure 10:
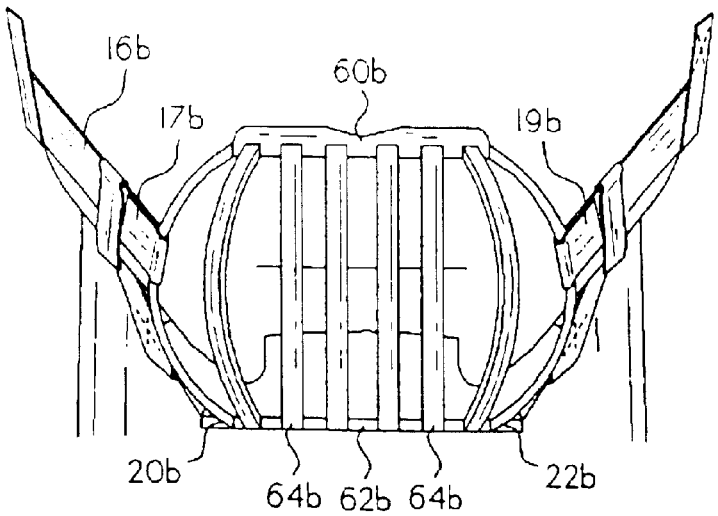
FIG. 10 is a fragmentary front plan view showing the modified chin support portion of the assembly.

There is shown in FIG. 9 another embodiment of mouth protector assembly in accordance with the present invention, wherein some of the elements or components of the assembly are the same as the principal embodiment and therefore are assigned the same reference numbers with a subscript "b". Thus, the protector assembly includes a lower strap 16*b*, a grid-like mouth protector 12*b* for the mouth and teeth area of the user and an upper strap 40*b* which spans the head of the user in the same manner as in the main embodiment. However, in the present instance, the mouth protector 12 has a base extension 80 projecting rearwardly from the bottom bar 62*b* and a chin support cushion 82 is provided which is contoured to the chin of the user and is supported in the base by suitable adhesive. An auxiliary or connector strap 84 is provided on either side of the mouth protector which spans the lower strap 60*b* and is suitably connected to the base pad 80.

Figure 11:
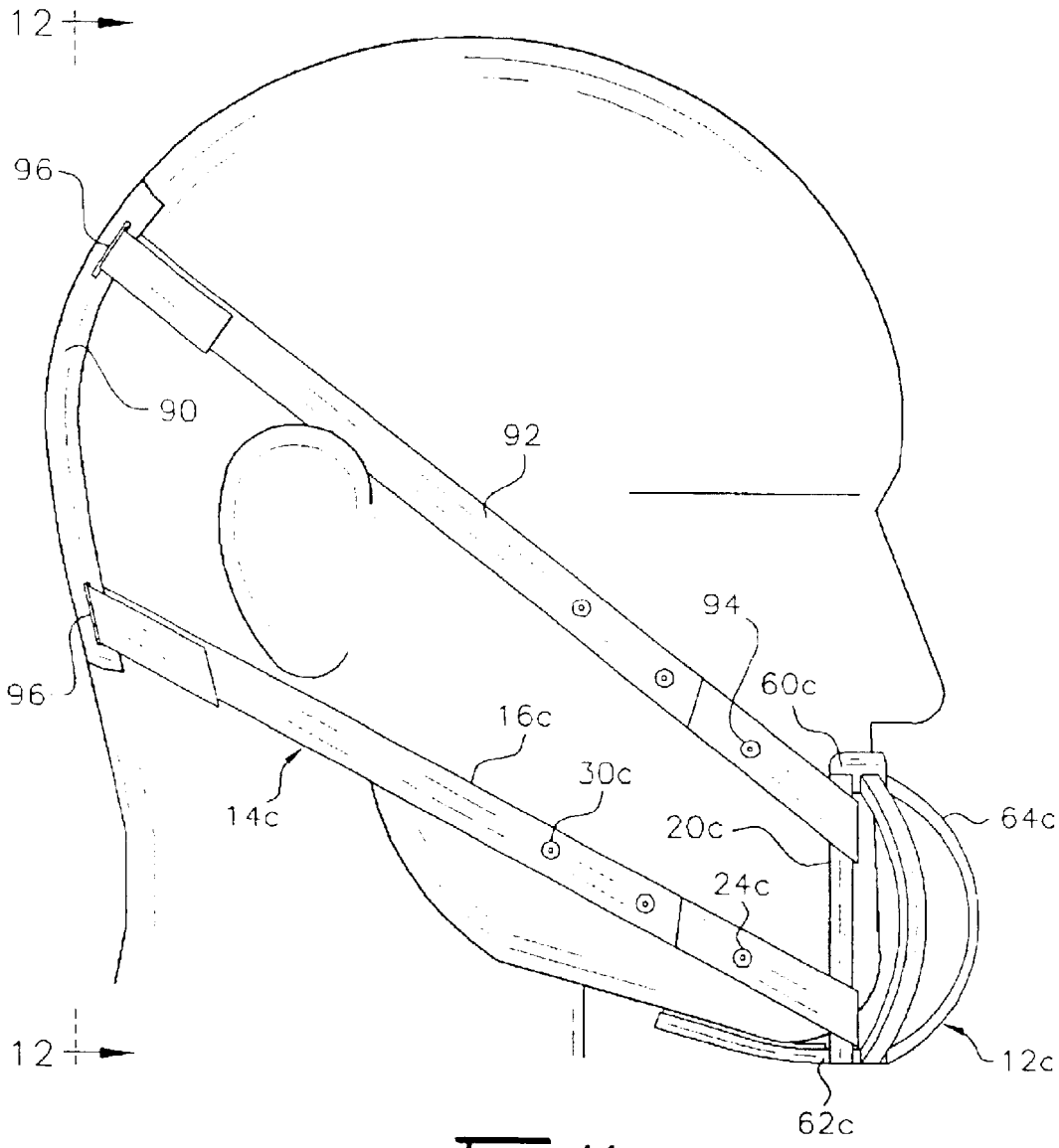
FIG. 11 is a side elevational view of another embodiment of mouth guard protective assembly in accordance with the present invention.
Figure 12:
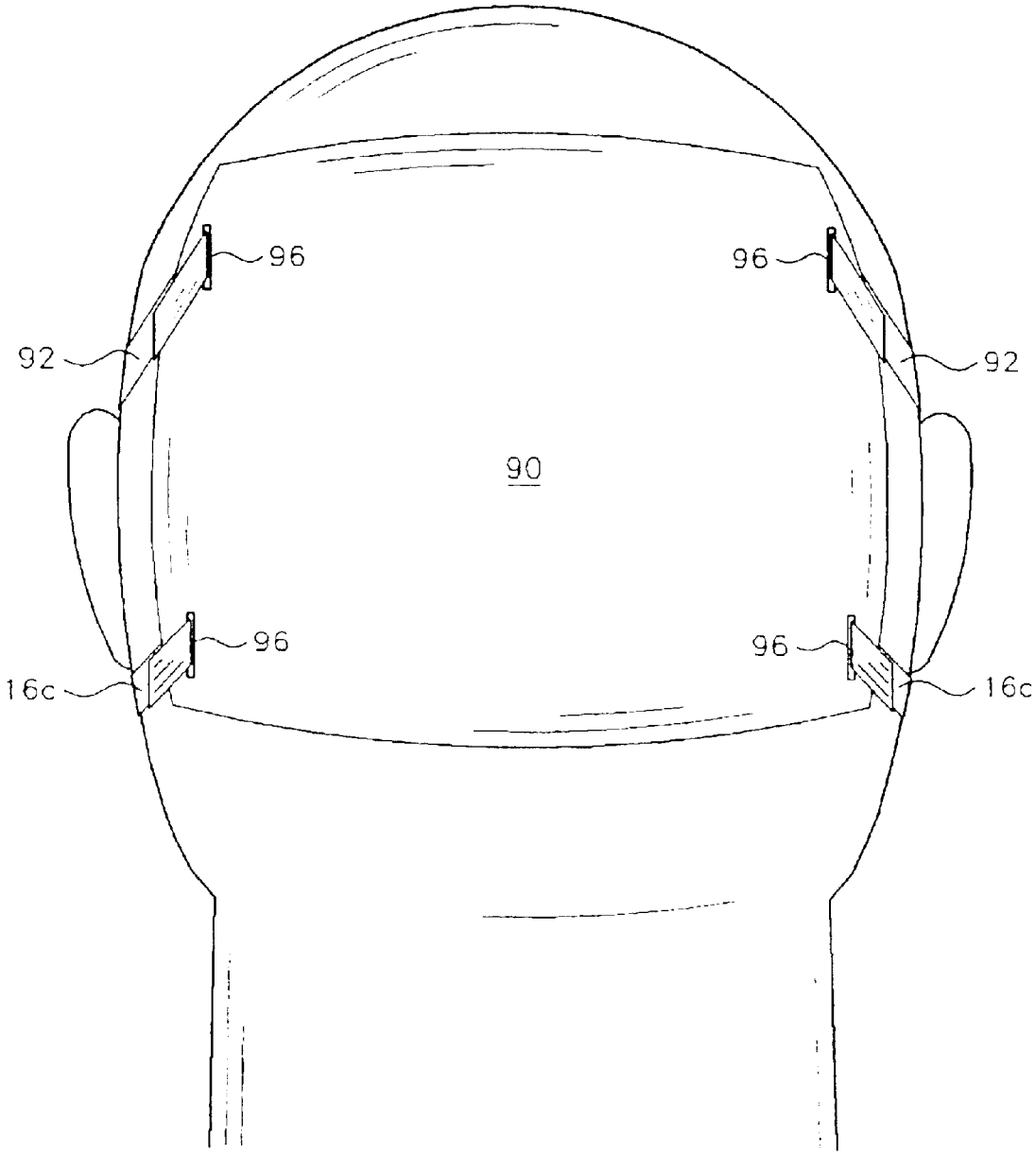
FIG. 12 is a rear elevational view showing the support structure for holding the mouth guard in place.

FIGS. 11 and 12 illustrate another embodiment of mouth protector assembly in accordance with the present invention wherein elements of the assembly which are the same as the principal embodiment are assigned the same reference numeral with the subscript "C" and new elements are given a new reference number.

Accordingly the mouth protector assembly includes a grid-like mouth protector 12*c* is supported in place to protect the mouth and teeth area of a user by a strap system connected between the protector 12*c* and a pad 90 which conforms to and seats on the back portion of the head of the user above the neck. The pad 90 is made of a soft, pliable elastic material such as cloth. The pad 90 may be fortified to provide a measure of protection to the head. The support strap system comprises upper and lower straps 92 and 16*c* which connect at their inner ends to the outer bars 20*c* and 22*c*, and at their outer ends to the upper and lower corners of the pad 90. The looped ends of the straps on one side of the pad 90 may be permanently attached as by sewing or the line and the looped ends at the opposite side of the pad 90 may be removably secured by velcro or the like to provide for adjustment and a snug fit. As illustrated, the straps loop around the bars 20*c* and 22*c* and are secured by snap fasteners as at 24*c* and 94. There are a series of fasteners to permit adjustment of the straps to a comfortable snug position. The outer ends loop through openings 96 at the corners of the pad 90 so that the straps on both sides straddle the ear in the manner shown for comfort.

Even though particular embodiments of the present invention have been illustrated and described herein, changes and modification may be made therein within the scope of the following claims.

What is claimed is:

1. A mouth protector assembly comprising a grid-like mouth protector, defined by a top bar contoured to engage the area above the upper lip and below the nose of a user, a series of spaced bars depending from the upper bar and a pad which underlies the chin of a user, a strap system for supporting the grid over the mouth including at least one strap connected to the grid and connected to opposite ends of the grid.

2. A mouth protector assembly as claimed in claim 1 including a contoured lower jaw piece and wherein the straps comprise a lower strap and an upper strap, said upper strap adapted to be connected to said jaw piece by engaging it through a slotted opening in the jaw piece.

3. A mouth protector assembly as claimed in claim 1, including a base extension (80) projecting rearwardly from the bottom bar (62*b*) and a chin support cushion (82) contoured to the chin and supported in the base and an auxiliary connector strap (84) disposed on either side of the mouth protector assembly which spans the lower strap (60*b*) and is connected to the base pad (80).

4. A mouth protector assembly as claimed in claim 1 wherein said upper and lower bar straps (92, 16*c*) connect at their inner ends to the outer bars (20*c*, 22*c*) and to of the pad (90) to the upper and lower corners.

5. A mouth protector assembly as claimed in claim 4 wherein the looped ends of the straps on one side of the pad (90) are permanently attached to the looped ends of the opposite of the pad to provide for adjustment and a snug fit.

6. A mouth protector assembly as claimed in claim 5 wherein the straps are secured by snap fasteners and wherein the outer ends loop through openings (96) at the corners of pad (90).

* * * * *